US006504934B1

(12) United States Patent
Kasai et al.

(10) Patent No.: US 6,504,934 B1
(45) Date of Patent: Jan. 7, 2003

(54) APPARATUS AND METHOD FOR LOCALIZING SOUND IMAGE

(75) Inventors: Joji Kasai, Neyagawa (JP); Koichi Sadaie, Neyagawa (JP); Kenichiro Toyofuku, Neyagawa (JP); Kazumasa Takemura, Neyagawa (JP); Tetsuro Nakatake, Neyagawa (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 09/235,483

(22) Filed: Jan. 22, 1999

(30) Foreign Application Priority Data

Jan. 23, 1998 (JP) ..... 10-026512
Jan. 30, 1998 (JP) ..... 10-034301

(51) Int. Cl.[7] ..... H04R 5/00
(52) U.S. Cl. ..... 381/17; 381/1
(58) Field of Search ..... 381/1, 17, 18

(56) References Cited

U.S. PATENT DOCUMENTS 5,440,638 A 8/1995 Lowe et al. ..... 381/17
5,579,396 A 11/1996 Iida et al. ..... 381/18

FOREIGN PATENT DOCUMENTS

EP 0 664 661 7/1995
JP 8-205298 8/1996
WO WO 93/25054 12/1993

OTHER PUBLICATIONS

Patent Abstracts of Japan, vol. 016, No. 200 (E–1201), May 13, 1992—& JP 04 030700 A (Roland Corp), Feb. 3, 1992 *abstract*.

*Primary Examiner*—Ping Lee
(74) *Attorney, Agent, or Firm*—Michael D. Bednarek; Shaw Pittman LLP

(57) ABSTRACT

The present invention includes producing a first processed signal which localizes sound image at a first localization position and a second processed signal which localizes sound image at a second localization position; multiplying one of the first and the second processed signals by a coefficient k which varies in the range of 0 to 1; multiplying the other signal by a coefficient 1–k; and adding the processed signal multiplied by the coefficient k and the processed signal multiplied by the coefficient 1–k. When the predetermined position is located away at an angle θ in a circumferential direction from the front of the listener, the first localization position is in the vicinity of the predetermined position and located away at an angle $\theta_1$ in a circumferential direction from the front of the listener wherein $\theta_1<\theta$, and the second localization position is in the vicinity of the predetermined position and located away at an angle $\theta_2$ in a circumferential direction from the front of the listener wherein $\theta_2>\theta$.

6 Claims, 16 Drawing Sheets

APPARATUS AND METHOD FOR LOCALIZING SOUND IMAGE

BACKGROUND OF THE INVENTION

1. Field of the Invention

The present invention relates to an apparatus and a method for localizing sound image.

2. Description of the Related Art

Conventionally, a home television (TV) set capable of performing a stereophonic audio reproduction includes a pair of speakers (i.e., a left speaker and a right speaker). However, since such a TV set has a limited width for installing the speakers therein, it is not possible to enjoy stereophonic audio reproduction at satisfactory level. Furthermore, if such a TV set employs a "surround system", it is often difficult to provide surround speakers.

In such a case, audio signals are subjected to a localization treatment of sound image (e.g., by using a head-related transfer function (HRTF)) and the treated signals are supplied to the speakers, so as to localize sound image (i.e., virtual speakers) at positions where speakers are not actually arranged. The virtual speakers make a listener to feel that the distance between the actually arranged speakers is widen, or to feel that the listener hears reproduced sound from sideward or rearward of the listener although only two frontal speakers are actually arranged in front of the listener.

Generally, in the case of moving sound image, it is relatively easy to localize the sound image at a predetermined position although it depends on a listener. In contrast, in the case of staying sound image, it is difficult to localize the sound image at a predetermined position.

In order to overcome the above-mentioned problem, a technique making a listener to recognize sound image at a predetermined position has been proposed. When the predetermined position is located away at an angle $\theta$ in a circumferential direction from the front of the listener, the technique includes producing (i) a first processed signal for localizing sound image at a first localization position located away at an angle $\theta_1$ in a circumferential direction from the front of the listener wherein $\theta_1<\theta$, and (ii) a second processed signal for localizing sound image at a second localization position located away at an angle $\theta_2$ in a circumferential direction from the front of the listener wherein $\theta_2>\theta$; and alternately supplying the first and the second processed signals to the speakers, so as to alternately localize sound image at the first and the second localization position for making the listener to recognize sound image at the predetermined position.

However, such a technique provides the listener with a quite unnatural feeling of hearing due to the regularity of the alternate sound image localization around the predetermined position.

Next, the case of moving sound image will be described.

An apparatus, wherein a pair of speakers are arranged at positions left and right front sides of a listener and wherein a single audio signal is divided into two branched signals to be supplied to the respective speakers, is capable of moving sound image in a left or right direction between the speakers. The sound image movement is accomplished by, for example, continuously increasing an amplitude (a level) of one of the branched signals as well as continuously decreasing an amplitude of another branched signal.

However, in the case of simply increasing and decreasing the amplitude of the branched signals, a listener often feels that the sound image is moving in an area rearwards to the speakers when the sound image is located at the middle between the speakers. In order to make the listener to feel that the sound image is moving in a left or right direction between the speakers, the following procedure is conventionally employed.

(i) When sound image is located at the middle between the left and right speakers, the procedure includes increasing an amplitude of the branched signals in a small amount, respectively. (ii) When sound image is moving from left or right side to the middle between the speakers, the procedure includes shifting a frequency component to high frequency side in advance, and then returning the shifted component to an original one as sound image is moving to the middle between the speakers. In contrast, when sound image is moving from the middle between the speakers to left or right side, the procedure includes shifting a frequency component to low frequency side in advance, and then returning the shifted component to an original one as sound image is moving to left or right side. In other words, the procedure includes incorporating the Doppler effect. Alternatively, (iii) when sound image is moving from left or right side to the middle between the speakers, the procedure includes virtually increasing a high frequency component of the branched signals and decreasing a low frequency component thereof. In contrast, when sound image is moving from the middle between the speakers to left or right side, the procedure includes virtually increasing a low frequency component of the branched signals and decreasing a high frequency component thereof.

As described above, it is relatively easy to make a listener to feel that sound image is moving in a left or right direction. However, it is difficult to make a listener to feel that sound image is moving forward and backward with respect to the listener by using only two speakers (i.e., the left and right speakers).

For example, when sound image is approaching a listener, it is possible to make the listener to feel that the sound image is approaching the listener to some extent, by gradually increasing an amplitude of the branched signals. Especially, when a picture image is accompanied with the sound image, such a feeling may be emphasized. However, it is not possible to make a listener to feel that sound image is approaching the listener sufficiently or moving rearwards with respect to the listener.

In order to overcome the above-mentioned problem, the below-indicated technique has been proposed. As shown in FIG. 26, when branched signals supplied to a left speaker 211 and a right speaker 212 have the same phase (i.e., the correlation is 1), a listener 214 feels that sound image 213 is located at the position 220 rearwards of the middle between the speakers 211 and 212; when the phase difference between the branched signals is 90 degrees (i.e., the correlation is zero), a listener 214 feels that sound image 213 is widen in an area 221 between the speakers 211 and 212; when the phase difference between the branched signals is 180 degrees (i.e., the correlation is −1), a listener 214 feels that sound image 213 is located at an area 222 rearwards to the listener 214. The technique includes moving sound image 213 forward and backward with respect to the listener by varying the phase difference between the branched signals (i.e., by using a relationship shown in FIG. 26).

However, even when the above-mentioned technique is utilized, it is not possible to make a listener 214 to clearly feel that sound image 213 is moving forward and backward with respect to the listener.

As described above, an apparatus and a method for localizing sound image which provide a natural feeling of hearing is eagerly demanded.

SUMMARY OF THE INVENTION

The present invention includes the steps of providing a left speaker and a right speaker in front of a listener; subjecting an audio signal to a sound image localization treatment, so as to produce a processed signal; and supplying the processed signal to the left and the right speakers, so as to localize sound image at a predetermined position. Wherein the method further includes: producing a first processed signal which localizes sound image at a first localization position and a second processed signal which localizes sound image at a second localization position; multiplying one of the first and the second processed signals by a coefficient k which varies in the range of 0 to 1; multiplying the other signal by a coefficient 1−k; and adding the processed signal multiplied by the coefficient k and the processed signal multiplied by the coefficient 1−k. When the predetermined position is located away at an angle $\theta$ in a circumferential direction from the front of the listener, the first localization position is in the vicinity of the predetermined position and located away at an angle $\theta_1$ in a circumferential direction from the front of the listener wherein $\theta_1<\theta$, and the second localization position is in the vicinity of the predetermined position and located away at an angle $\theta_2$ in a circumferential direction from the front of the listener wherein $\theta_2>\theta$.

In one embodiment of the invention, a spectrum of the coefficient k has 1/f characteristics.

In another embodiment of the invention, a production of the coefficient k includes outputting a random signal having rectangular pulse shape, height of 1, and random pulse width and pitch, and integrating the random signal in an integration circuit.

In still another embodiment of the invention, a production of the coefficient k includes squaring the audio signal by a squaring circuit, and processing the squared signal through a low pass filter.

In still another embodiment of the invention, the audio signal is a 2-channel stereophonic signal, and a signal for producing the coefficient is selected from a signal of one of the channels, an added signal of the both channel, or a differential signal of the both channel.

According to another aspect of the present invention, an apparatus for localizing sound image is provided. The apparatus includes: a left and a right speakers to be provided in front of a listener; a means for subjecting an audio signal to a sound image localization treatment so as to produce a processed signal; and a means for supplying the processed signal to the left and the right speakers so as to localize sound image at a predetermined position. Wherein the apparatus further includes: a means for producing a first processed signal which localizes sound image at a first localization position; a means for producing a second processed signal which localizes sound image at a second localization position; a means for producing a coefficient k which varies in the range of 0 to 1; a means for multiplying one of the first and the second processed signals by the coefficient k; a means for multiplying the other signal by a coefficient 1−k; and a means for adding the processed signal multiplied by the coefficient k and the processed signal multiplied by the coefficient 1−k and supplying the added signal to the left and the right speakers. When the predetermined position is located away at an angle $\theta$ in a circumferential direction from the front of the listener, the first localization position is in the vicinity of the predetermined position and located away at an angle $\theta_1$ in a circumferential direction from the front of the listener wherein $\theta_1<\theta$, and the second localization position is in the vicinity of the predetermined position and located away at an angle $\theta_2$ in a circumferential direction from the front of the listener wherein $\theta_2>\theta$.

According to still another aspect of the present invention, a method for moving sound image is provided. The method includes the steps of: producing a single audio signal; dividing the single audio signal into two branched signals; shifting a frequency component of the audio signal or the branched signals; amplifying an amplitude of the audio signal or the branched signal; varying a phase difference between the branched signals; and supplying the branched signals to a left and a right speakers. The combination of the shift of the frequency component, the variation of the amplitude and the variation of the phase difference makes a listener to feel that sound image is moving forward and backward with respect to the listener.

In one embodiment of the invention, the combination comprises the steps of: increasing the amplitude of the branched signals; increasing the phase difference between the branched signals from zero degree to 180 degrees; decreasing the amplitude of the branched signals to approximately zero while keeping the phase difference approximately at 180 degrees; and shifting the frequency component of the branched signals to low frequency side.

In another embodiment of the invention, the combination comprises the steps of: keeping the phase difference between the branched signals approximately at 180 degrees while keeping the amplitude of the branched signals identical to each other; decreasing the amplitude and the phase difference to approximately zero; and shifting the frequency component of the branched signals to low frequency side.

According to still another aspect of the invention, an apparatus for moving sound image is provided. The apparatus includes: a source which produces a single audio signal; a means for dividing the single audio signal into two branched signal; a means for shifting a frequency component of the audio signal or the branched signals; a means for amplifying an amplitude of the audio signal or the branched signal; a means for varying a phase difference between the branched signals; and a left and a right speakers to which the branched signals are respectively supplied. The combination of the shifting means, the amplifying means and the phase difference varying means makes a listener to feel that sound image is moving forward and backward with respect to the listener.

Thus, the invention described herein makes the possible the advantages of: (1) providing an apparatus for localizing sound image which provides a natural feeling of hearing; and (2) a method for localizing sound image which provides a natural feeling of hearing.

These and other advantages of the present invention will become apparent to those skilled in the art upon reading and understanding the following detailed description with reference to the accompanying figures.

DETAILED DESCRIPTION OF THE PREFERRED EMBODIMENTS

In the present specification, the phrase "localizing sound image" includes not only forming sound image at prescribed positions but also moving sound image.

Embodiment 1

Referring to FIGS. 1 to 9, an embodiment according to the present invention will be described.

Figure 1:
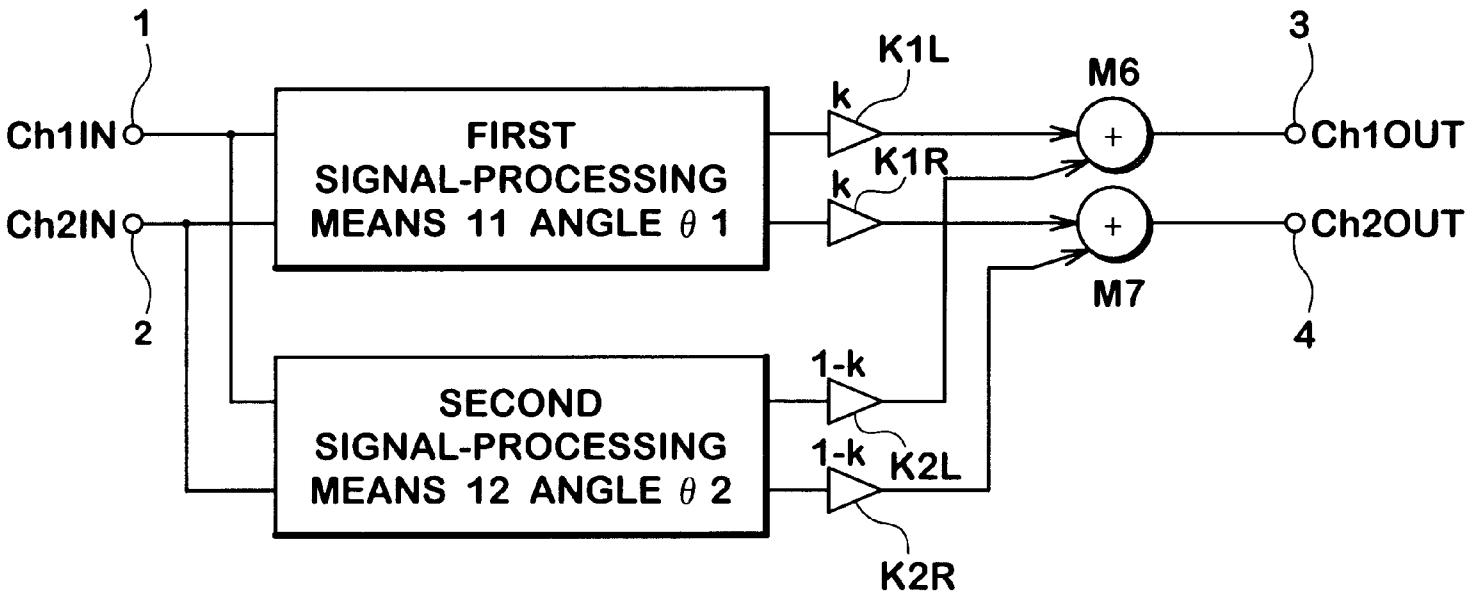
FIG. 1 is a block diagram illustrating an embodiment of an apparatus for localizing sound image according to the present invention.

FIG. 1 is a block diagram illustrating an apparatus according to this embodiment. The sound image localization apparatus (the virtual speaker treatment apparatus) includes a first and a second input terminals 1 and 2 to which an audio signal is input, a first output terminal 3 connected to a left speaker SPL and a second output terminal 4 connected to a right speaker SPR. Although 2-channel stereophonic signal as an audio signal is exemplarily shown in FIG. 1, an audio signal may also be a monophonic signal.

Figure 2:
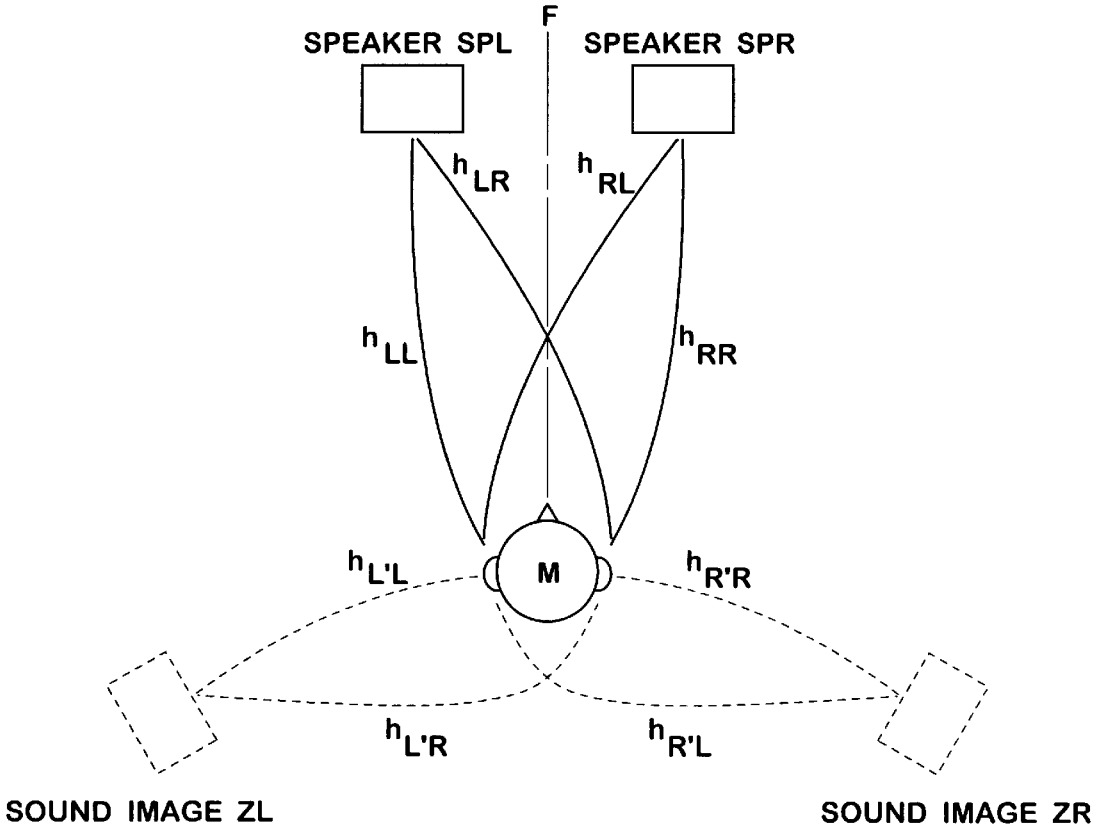
FIG. 2 is a configuration diagram illustrating a localization treatment of sound image using an apparatus of FIG. 1.

FIG. 2 shows an arrangement of the speakers SPL and SPR. As shown in FIG. 2, a pair of speakers (i.e., a left speaker SPL and a right speaker SPR) are provided in front of a listener M.

Figure 9:
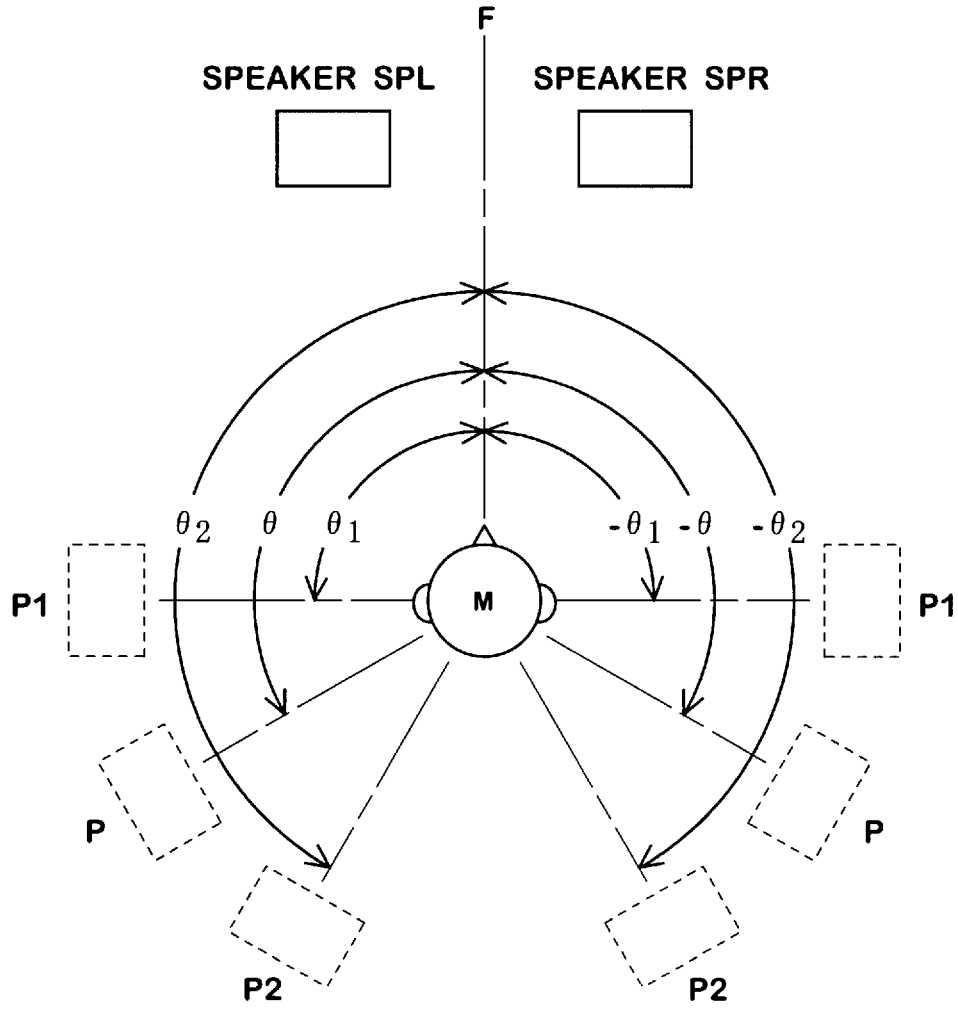
FIG. 9 is a schematic diagram illustrating a relationship among $\theta_1$, $\theta_2$ and $\theta$ according to the present invention.

As shown in FIG. 9, the sound image localization apparatus makes a listener M to recognize sound image at the predetermined position P. Here, the position P is located away at an angle $\theta$ in a circumferential direction (i.e., counter-clockwise) from the front F of the listener M, this embodiment of the present invention includes (1) localizing sound image (a virtual speaker) at a first localization position P1 which is in the vicinity of the predetermined position P and located away at an angle $\theta_1$ in the circumferential direction from the front F of the listener wherein $\theta_1<\theta$; and (2) localizing sound image (a virtual speaker) at a second localization position P2 which is in the vicinity of the predetermined position P and located away at an angle $\theta_2$ in the circumferential direction from the front F of the listener wherein $\theta_2>\theta$.

As shown in FIG. 9 also, when the position P is located away at an angle $-\theta$ in another circumferential direction (i.e., clockwise) from the front F of the listener, this embodiment of the present invention includes (1) localizing sound image (a virtual speaker) at a first localization position P1 which is in the vicinity of the predetermined position P and located away at an angle $-\theta_1$ in the circumferential direction from the front F of the listener; and (2) localizing sound image (a virtual speaker) at a second localization position P2 which is in the vicinity of the predetermined position P and located away at an angle $-\theta_2$ in the circumferential direction from the front F of the listener.

The difference between $\theta$ and $\theta_1$ and the difference between $\theta$ and $\theta_2$ may be the same or different. The difference between $\theta$ and $\theta_1$ or between $\theta$ and $\theta_2$ may be any suitable amount of angle, and typically, it may be about 30 degrees or less.

The sound image localization apparatus includes a first signal-processing means (a first virtual speaker treatment means) 11 and a second signal-processing means (a second virtual speaker treatment means) 12. The first and the second means are connected to input terminals 1 and 2. The first signal-processing means 11 is used for localizing sound image at a first localization position P1 and outputs a first L-signal for a left speaker SPL and a first R-signal for a right speaker SPR. The second signal-processing means 12 is used for localizing sound image at a second localization position P2 and outputs a second L-signal for a left speaker SPL and a second R-signal for a right speaker SPR.

The first and the second signal-processing means 11 and 12 are typically signal-processing circuits. For example, the means 11 and 12 may be a "lattice type" filter or a "shuffler type" filter. More specifically, the sound image localization apparatus may include a pair of lattice type filters or a pair of shuffler type filters. A method for localizing sound image, which provides a listener with a "surround" feeling by using such filters, have already been proposed by the present inventors.

Figure 3:
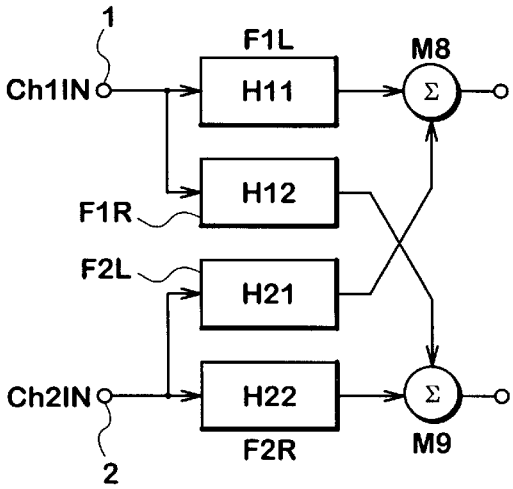
FIG. 3 is a block diagram illustrating an example of a first and a second signal processing means of FIG. 1.

As shown in FIG. 3, a lattice type filter includes: (i) a first L-filtering portion (a first L-signal-processing portion) F1L, which is connected to a first input terminal 1 and outputs an output signal for a left speaker SPL; (ii) a first R-filtering portion (a first R-signal-processing portion) F1R, which is connected to a first input terminal 1 and outputs an output signal for a right speaker SPR; (iii) a second L-filtering portion (a second L-signal-processing portion) F2L, which is connected to a second input terminal 2 and outputs an output signal for a left speaker SPL; (iv) a second R-filtering portion (a second R-signal-processing portion) F2R, which is connected to a second input terminal 2 and outputs an output signal for a right speaker SPR; (v) an adding means MS which adds output signals of a first and a second L-filtering portions F1L and F2L so as to produce a first L-processed signal or a second L-processed signal; (vi) an adding means M9 which adds output signals of a first and a second R-filtering portions F1R and F2R so as to produce a first R-processed signal or a second R-processed signal. A transfer function of a first L-filtering portion FIL, a first R-filtering portion F1R, a second L-filtering portion F2L and a second R-filtering portion F2R is defined as $H_{11}$, $H_{12}$, $H_{21}$ and $H_{22}$, respectively. The details of the transfer function are described below.

For example, in the case of localizing sound image (i.e., virtual left and right speakers) ZL and ZR at positions sideward or rearward of the listener M as shown in FIG. 2, transfer functions $H_{11}$, $H_{12}$, $H_{21}$, and $H_{22}$ of the first L-filtering portion F1L, the first R-filtering portion F1R, the second L-filtering portion F2L and the second R-filtering portion F2R are obtained by using head-related transfer functions $h_{LL}$, $h_{LR}$, $h_{RL}$, $h_{RR}$, $h_{L'L}$, $h_{L'R}$, $h_{R'L}$ and $h_{R'R}$. Here, $h_{LL}$ is a head-related transfer function from the left speaker SPL to a left ear of the listener M, and $h_{LR}$ is a head-related transfer function from the left speaker SPL to a right ear of the listener M; $h_{RL}$ ; is a head-related transfer function from the right speaker SPR to a left ear of the listener M, and $h_{RR}$ is a head-related transfer function from the right speaker SPR to a right ear of the listener M; $h_{L'L}$ is a head-related transfer function from the virtual left speaker ZL to a left ear of the listener M, and $h_{L'R}$ is a head-related transfer function from the virtual left speaker ZL to a right ear of the listener M; and $h_{R'L}$ is a head-related transfer function from the virtual right speaker ZR to a left ear of the listener M, and $h_{R'R}$ is a head-related transfer function from the virtual right speaker ZR to a right ear of the listener M. The calculation procedure is as follows.

Initially, defining as indicated below a matrix [h] of the head-related transfer functions from the speakers SPL and SPR to the ears of the listener M, a matrix [h'] of the head-related transfer functions from the virtual speakers ZL and ZR to the ears of the listener M, and a matrix [H] of the lattice type filter.

$$[h] = \begin{bmatrix} h_{LL} & h_{LR} \\ h_{RL} & h_{RR} \end{bmatrix}^T \tag{1}$$

-continued $$[h'] = \begin{bmatrix} h_{L'L} & h_{L'R} \\ h_{R'L} & h_{R'R} \end{bmatrix}^T \tag{2}$$

$$[H] = \begin{bmatrix} H_{11} & H_{12} \\ H_{21} & H_{22} \end{bmatrix}^T \tag{3}$$

According to the relationship shown in FIGS. 2 and 3, the following equation is satisfied:

$$[h']=[h][H] \tag{4}$$

If $|h|\neq 0$, then the below-indicated equation (5) can be derived from equation (4):

$$[H]=[h]^{-1}[h'] \tag{5}$$

Transfer functions $H_{11}$, $H_{12}$, $H_{21}$ and $H_{22}$ of the first L-filtering portion F1L, the first R-filtering portion F1R, the second L-filtering portion F2L and the second R-filtering portion F2R can be obtained by using equation (5) as follows:

$$H_{11}=(h_{RR}h_{L'L}-h_{RL}h_{L'R})/(h_{LL}h_{RR}-h_{LR}h_{RL}) \tag{6}$$

$$H_{12}=(h_{LL}h_{L'R}-h_{LR}h_{L'L})/(h_{LL}h_{RR}-h_{LR}h_{RL}) \tag{7}$$

$$H_{21}=(h_{RR}h_{R'L}-h_{RL}h_{R'R})/(h_{LL}h_{RR}-h_{LR}h_{RL}) \tag{8}$$

$$H_{22}=(h_{LL}h_{R'R}-h_{LR}h_{R'L})/(h_{LL}h_{RR}-h_{LR}h_{RL} \tag{9}$$

Figure 4:
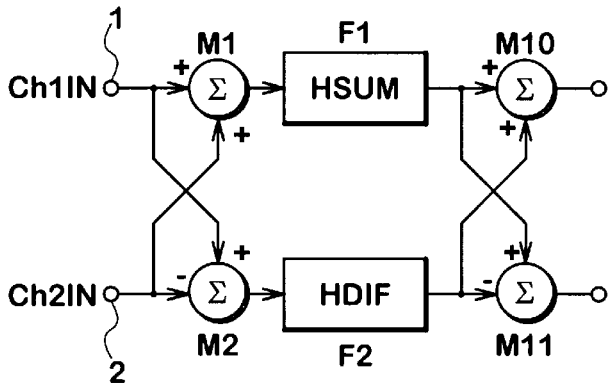
FIG. 4 is a block diagram illustrating another example of a first and a second signal processing means of FIG. 1.

Alternatively, as shown in FIG. 4, a shuffler type filter includes: a first filtering portion (a first signal-processing portion) F1; a second filtering portion (a second signal-processing portion) F2; an adding means M1 which adds audio signals input to the first and second terminals 1 and 2 and inputs the added signal to the first filtering portion F1; a subtract means M2 which calculates a differential signal of the audio signals input to the first and second terminals 1 and 2 and inputs the differential signal to the second filtering portion F2; an adding means M10 which adds output signals of the first and the second filtering portions F1 and F2 so as to produce a first L-processed signal or a second L-processed signal; a subtract means M11 which subtracts output signal of the second filtering portion F2 from that of the first filtering portion F1 so as to produce a first R-processed signal or a second R-processed signal.

Typically, the shuffler type filter is used in the case where the left and the right speakers SPL and SPR and the left and the right sound image (virtual speakers) ZL and ZR are symmetrically arranged with respect to the listener M.

In the above-mentioned case, transfer functions $H_{SUM}$ and $H_{DIF}$ of the first and the second filtering portions F1 and F2 will be described. The transfer functions $H_{SUM}$ and $H_{DIF}$ can be obtained by using the above-mentioned head-related transfer functions $h_{LL}$, $h_{LR}$, $h_{RL}$, $h_{RR}$, $h_{L'L}$, $h_{L'R}$, $h_{R'L}$ and $h_{R'R}$ as follows:

Initially, since the speakers (the actual and the virtual speakers) are symmetrically arranged with respect to the listener, the relationship of $h_{LL}=h_{RR}$, $h_{LR}=h_{RL}$, $h_{L'L}=h_{R'R}$ and $h_{L'R}=h_{R'L}$ are satisfied in equations (6) to (9). As a result, $H_{11}=H_{22}$ and $H_{12}=H_{21}$ are satisfied.

Next, if using $h_a$ for $h_{LL}$ and $h_{RR}$, $h_b$ for $h_{LR}$ and $h_{RL}$, $h_a$, for $h_{L'L}$ and $h_{R'R}$, and $h_b$, for $h_{R'L}$ and $h_{R'L}$, then the transfer functions $H_{SUM}$ and $H_{DIF}$ are represented by the following equations:

$$H_{SUM}=(h_{a'}+h_{b'})/(h_a+h_b)$$

$$H_{DIF}=(h_{a'}+h_{b'})/(h_a+h_b)$$

In FIG. 1, K1L and K1R respectively denotes a first L-coefficient multiplying means and a first R-coefficient multiplying means. The first L- and R-coefficient multiplying means K1L and K1R respectively multiplies the first L-processed signal and the first R-processed signal (which signals are from the first signal-processing means 11) by a coefficient k. The coefficient k arbitrarily varies in the range of 0 to 1. K2L and K2R respectively denotes a second L-coefficient multiplying means and a second R-coefficient multiplying means. The second L- and R-coefficient multiplying means K2L and K2R respectively multiplies the second L-processed signal and the second R-processed signal (which signals are from the second signal-processing means 12) by a coefficient 1−k.

Preferably, a spectrum of the coefficient k has 1/f characteristics. Since the 1/f characteristics provides a physiological nature, an unnatural feeling of a listener can be eliminated by using the coefficient having 1/f characteristics. A method for producing the coefficient having 1/f characteristics will be described below.

Figure 5:
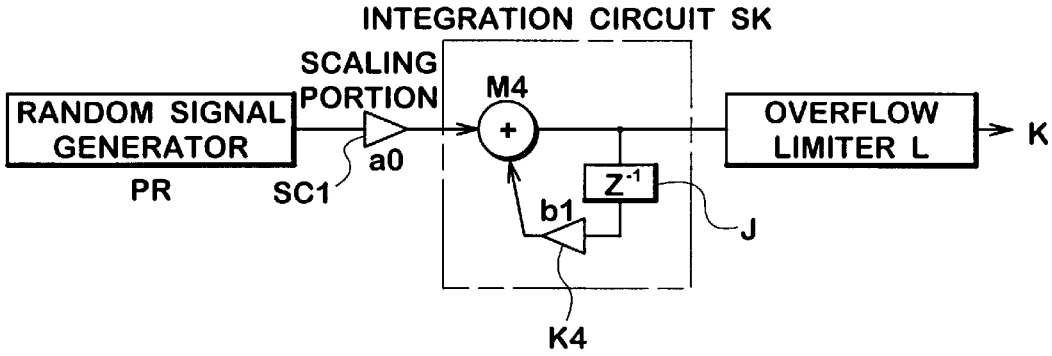
FIG. 5 is a block diagram illustrating an example of a means for producing coefficient k of FIG. 1.
Figure 6A:
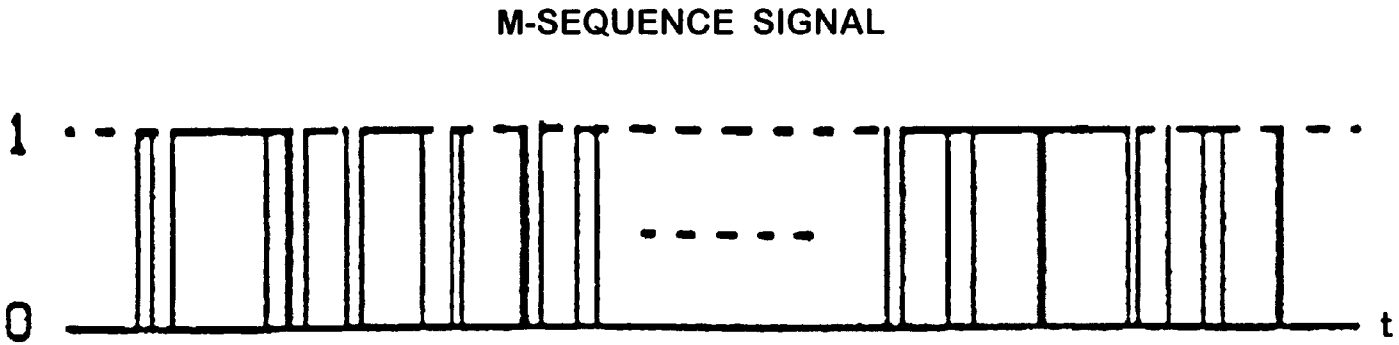
FIG. 6A shows an output from a random signal generator of FIG. 5.
Figure 6B:
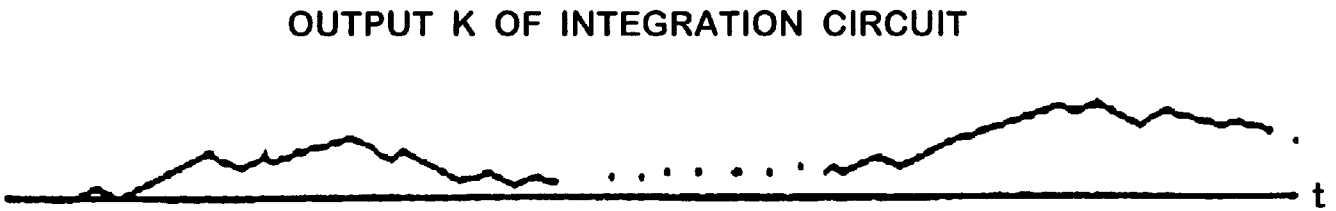
FIG. 6B shows an output from an integration circuit of FIG. 5.
Figure 7:
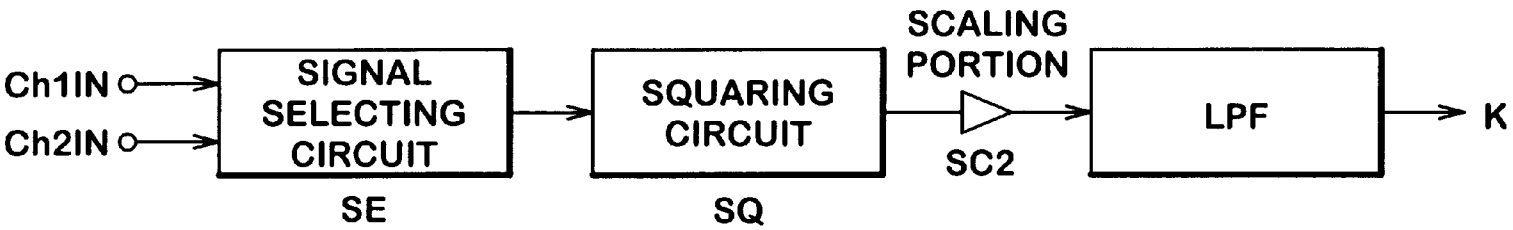
FIG. 7 is a block diagram illustrating another example of a means for producing coefficient k of FIG. 1.

As shown in FIGS. 5, 6A and 6B, the method includes outputting as a random signal an M-sequence signal from a random signal generator (e.g., a digital signal processor) PR. The signal is formed to be a pulse having rectangular shape, height of 1, and random width and pitch. The M-sequence signal is multiplied by a coefficient $a_0$ in a scaling portion SC1 so as to reduce a possibility that an output value in the succeeding step exceeds 1, and then, as shown in FIG. 6B, integrated with respect to time in an integration circuit SK. The integration circuit SK includes: a delay circuit J which delays an input signal by one sampling period; a coefficient multiplying means K4 which multiplies an output of the circuit J by a coefficient $b_1$; an adding means (e.g., mixer) M4 which adds an output of the coefficient multiplying means K4 to the input signal to the integration circuit SK. The output signal from the integration circuit SK is supplied to an overflow limiter L having a maximum limit value of 1, so as to produce a coefficient k. In the above-mentioned method, the scaling portion SC1 and the overflow limiter L can be omitted.

Figure 8A:
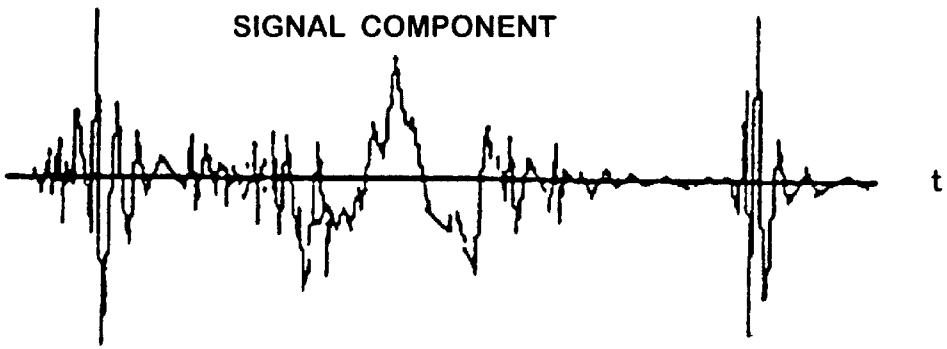
FIGS. 8A shows an output from a signal-selecting circuit of FIG. 7.
Figure 8B:
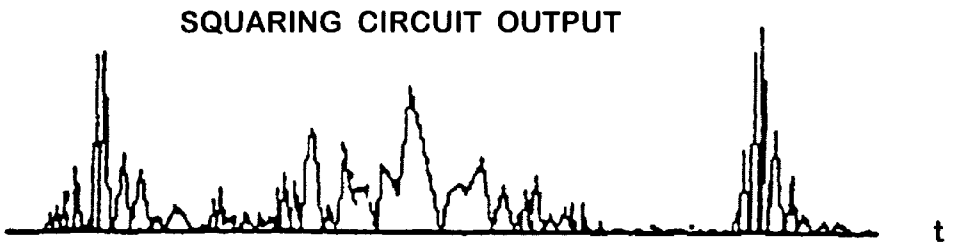
FIG. 8B shows an output from a squaring circuit of FIG. 7.
Figure 8C:
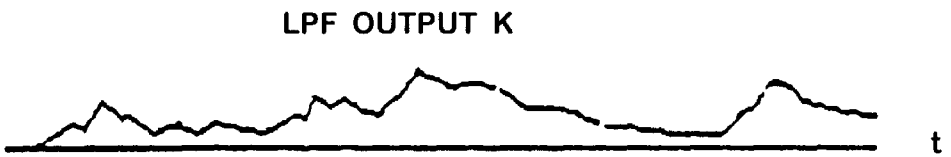
FIG. 8C shows an output from a low pass filter of FIG. 7.

An alternative method will be described with reference to FIGS. 7 and 8A to 8C. It is believed that, in many cases, a spectrum of a music signal essentially has 1/f characteristics. Therefore, in such a case, the method includes supplying an audio signal (2-channel stereophonic signal in FIG. 7) to a signal-selecting circuit (e.g., an adding and subtracting circuit) SE and selecting a signal for producing a coefficient from a signal of one of the channels, an added signal of the both channel, or a differential signal of the both channel. Then, the selected signal (shown in FIG. 8A) is squared by a squaring circuit SQ as shown in FIG. 8B. The squared signal is multiplied by an appropriate coefficient in a scaling portion SC2 so as to reduce a possibility that an output value in the succeeding step exceeds 1. Then, an output signal from the scaling portion SC2 is processed through a low pass filter LPF having a cut-off frequency of about 10 Hz so as to produce a coefficient k (FIG. 8C).

In FIG. 1, M6 and M7 respectively denotes an adding means (e.g., a mixer). The adding means M6 adds the first L-processed signal and the second L-processed signal both of which have been multiplied by the coefficient, and supplies the added signal to the left speaker SPL. The adding means M7 adds the first R-processed signal and the second R-processed signal both of which have been multiplied by the coefficient, and supplies the added signal to the right speaker SPR.

For example, in the case of making the listener M to recognize sound image at the predetermined position P located away at an angle θ (e.g., 120 degrees) counter-clockwise from the front F of the listener M, this embodiment of the present invention includes producing, by the first signal-processing means 11, the first L-processed signal and the first R-processed signal for localizing sound image at the first localization position P1 which is in the vicinity of the predetermined position P and located away at an angle $\theta_1$ (e.g., 90 degrees) counter-clockwise from the front F of the listener; and producing, by the second signal-processing means 12, the second L-processed signal and the second R-processed signal for localizing sound image at the second localization position P2 which is in the vicinity of the predetermined position P and located away at an angle $\theta_2$ (e.g., 150 degrees) counter-clockwise from the front F of the listener.

Next, the first L-processed signal and the first R-processed signal are multiplied by a coefficient k (which arbitrarily varies in the range of 0 to 1), and simultaneously the second L-processed signal and the second R-processed signal are multiplied by a coefficient 1−k. Then, the multiplied first L-processed signal and the multiplied second L-processed signal are added by the adding means M6 so as to be supplied to the left speaker SPL, and simultaneously the multiplied first R-processed signal and the multiplied second R-processed signal are added by the adding means M7 so as to be supplied to the right speaker SPR.

Accordingly, the first and the second L-processed signals added in a random ratio are supplied to the left speaker SPL, the first and the second R-processed signals added in a random ratio are supplied to the right speaker SPR. The speakers SPL and SPR output a sound wave. As a result, sound image is localized at a first and a second localization positions P1 and P2. Furthermore, a sound volume from the first and the second localization positions P1 and P2 is arbitrarily varied.

According to the above-mentioned embodiment, even when sound image is static at the position sideward and rearward of a listener M, it is possible to make the listener M to clearly recognize that the sound image is at the predetermined position P. Furthermore, since sound volume from the first localization position P1 arbitrarily varies, there is no concern to provide the listener M with an unnatural feeling.

Especially, when the coefficient k has 1/f characteristics, sound volume variation from the first and the second localization positions P1 and P2 is physiologically natural, thereby providing the listener M with a further natural feeling.

As described above, according to the present embodiment, an apparatus and a method for localizing sound image, which make a listener to clearly recognize that sound image is at the predetermined position and provide a listener with a natural feeling, can be obtained.

Embodiment 2

Referring to FIGS. 10 to 23, another embodiment according to the present invention will be described.

Figure 10:
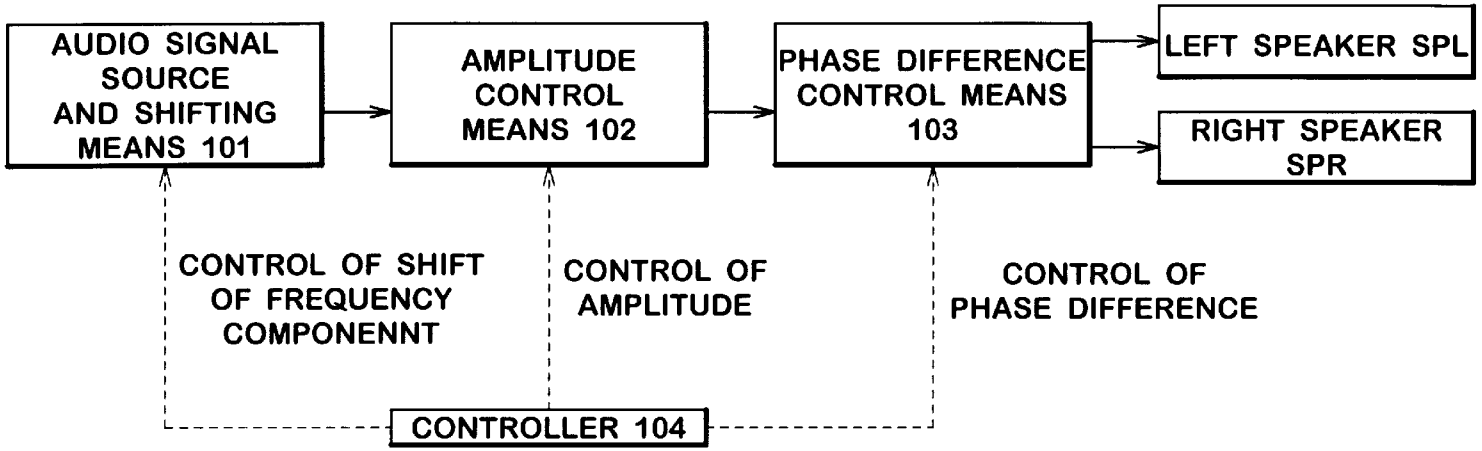
FIG. 10 is a block diagram illustrating another embodiment of an apparatus for localizing sound image according to the present invention.

FIG. 10 is a block diagram illustrating an apparatus according to this embodiment. The sound image localization apparatus includes: an audio signal source 101 (which also functions as a shifting means); an amplitude control means 102 (also referred to as an audio signal level control portion or a sound pressure control portion) connected to the audio signal source 101; a phase difference control means 103 (also referred to as a phase difference generating portion) connected to the amplitude control means 102; a controller (e.g., microcomputer) 104 which controls the respective means 101 to 103; a left and a right speakers SPL and SPR both of which are connected to the phase difference control means 103. The speakers SPL and SPR are arranged in front of a listener (an audience in the case where a picture is accompanied). The shifting means 101 produces a single audio signal and also shifts a frequency component (frequency band) of the audio signal by using the controller 104. The amplitude control means 102 increases and decreases an amplitude of the audio signal by using the controller 104. The phase difference control means 103 divides the audio signal into two branched signals, and increases and decreases a phase difference between the branched signals by using the controller 104.

Figure 11:
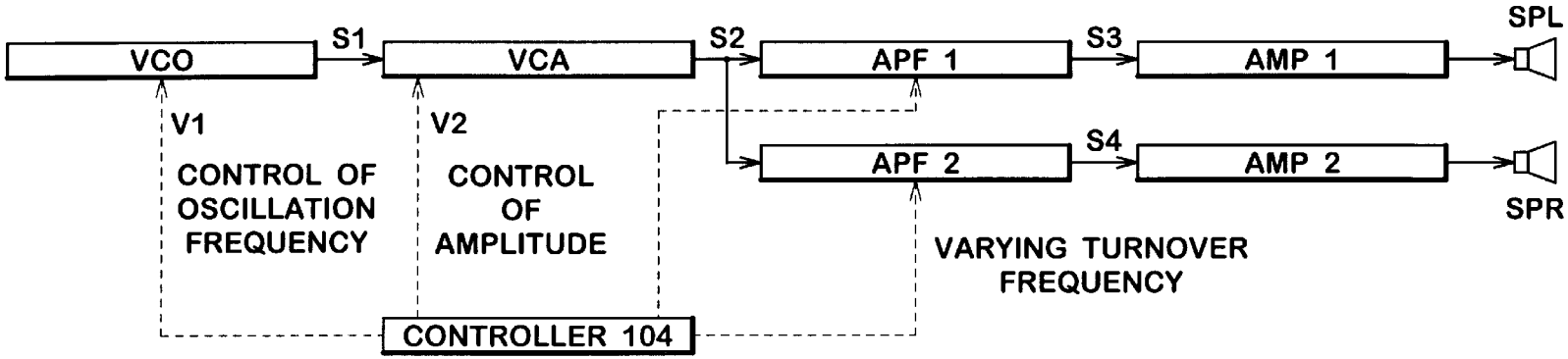
FIG. 11 is a block diagram illustrating an example of an apparatus of FIG. 10.
Figure 12:
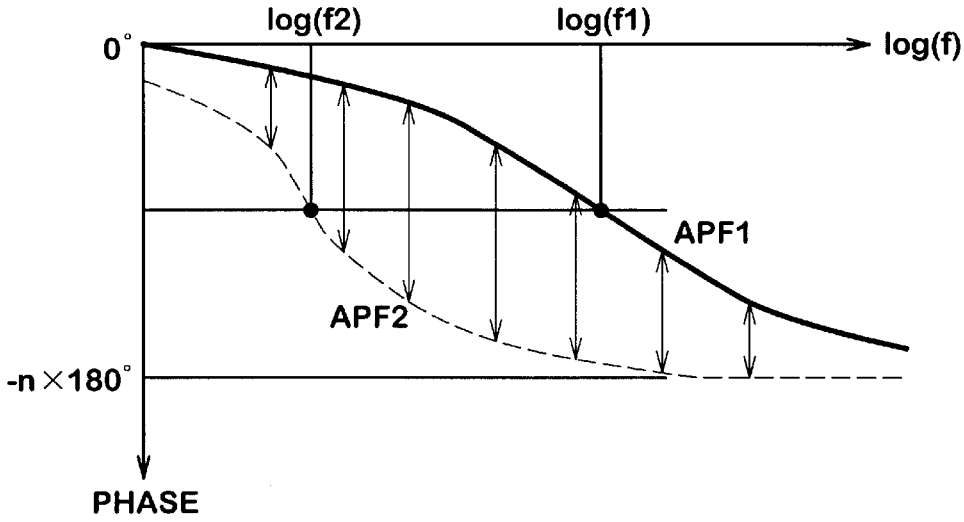
FIG. 12 is a graph showing a relationship between a delay of phase of each all pass filter (APF) output shown in FIG. 11 and a logarithm of a frequency.
Figure 13:
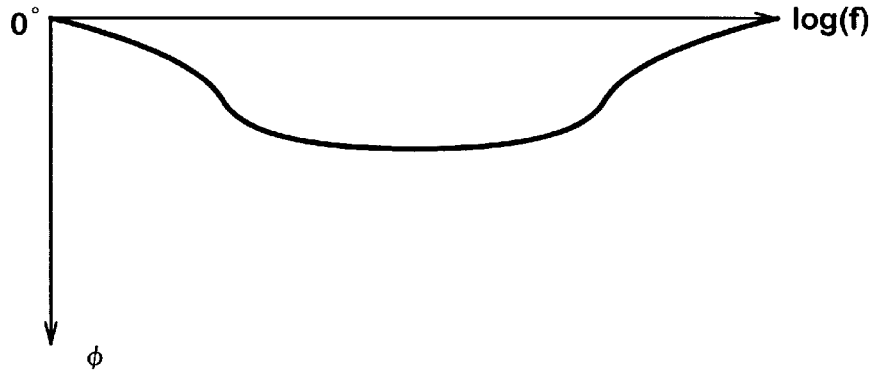
FIG. 13 is a graph showing a relationship between a phase difference between APF output signals shown in FIG. 12 and a logarithm of a frequency.

More specifically, referring to FIGS. 11 to 13, an analog type sound image localization apparatus will be described. As shown in FIG. 11, this type of apparatus includes a voltage control oscillator VCO as the shifting means. Control voltage V1 is applied to the voltage control oscillator VCO. A frequency component of the audio signal S1 oscillated from the oscillator VCO is shifted by varying the voltage V1 using the controller 104. Although a single oscillator is exemplified in FIG. 11, plural oscillators may be employed (in such a case, output of the respective oscillators is added to produce a single audio signal S1).

Also as shown in FIG. 11, a voltage control amplifier VCA is used as the amplitude control means 102. The amplifier VCA amplifies the audio signal S1 from the oscillator VCO so as to output the branched signals S2. Control voltage V2 is applied to the amplifier VCA. The voltage V2 is varied by the controller 104 so as to vary an amplification of the amplifier, as a result, an amplitude of the branched signals S2 is varied.

In addition, a first and a second all pass filters APF1 and APF2 are used as the phase difference control means 103. The branched signals S2 are supplied to the filters APF1 and APF2 so as to output branched signals S3 and S4, respectively. Control voltage or current applied to the filters APF1 and APF2 is varied by the controller 104, thereby a turnover frequency of at least one of the filters APF1 and APF2 is changed (delayed) continuously or stepwise (at an appropriate step). As a result, a phase of at least one of the branched signals S3 and S4 is varied so as to vary the phase difference (relative phase difference) of the branched signals S3 and S4 in the range of about 0 degree to about 180 degrees.

The phase of the branched signals S3 and S4 and the phase difference therebetween will be described with reference to FIGS. 12 and 13. Using f1 and f2 for the respective turnover frequency of the filters APF1 and APF2 and if f1>f2, then the phase of the branched signal S4 is delayed to that of the branched signal S3 (FIG. 12). As a result, as shown in FIG. 13, the phase difference $\phi$ between the branched signals S3 and S4 is small in a high and a low frequency regions and large in a middle frequency region which is a frequency band for reproduction. Also, as shown in FIG. 12, the maximum delay amount of the respective branched signals S3 and S4 depends on the order n of the filters APF1 and APF2. Therefore, the wider the frequency component (frequency band) of the signal is, the higher order n is required. However, according to this embodiment wherein the branched signals S3 and S4 function as an audio signal, since the frequency component of the branched signal S3 and S4 is relatively narrow, the order of the all pass filters is usually set to be second.

Figure 14:
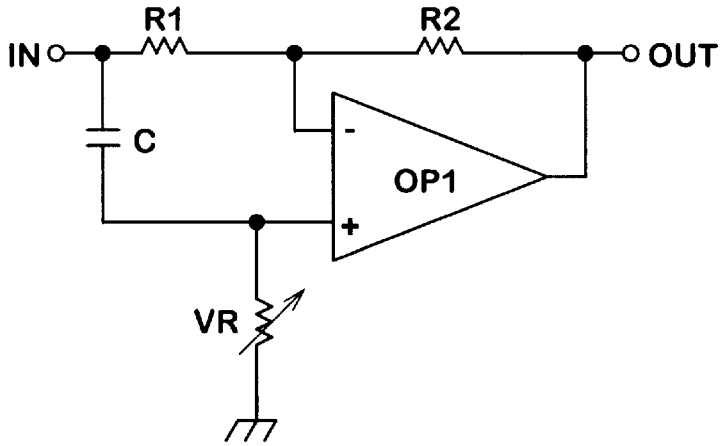
FIG. 14 is a circuit diagram illustrating an example of an APF of FIG. 11.

Examples of the all pass filter wherein the turnover frequency is controlled by the applied voltage or current includes the following:

One of the examples is as shown in FIG. 14. The all pass filter includes resistance R1 and R2, capacitor C, variable resistance VR, and operating amplifier OP1. The resistance R1 and the capacitor C are connected to the voltage control amplifier VCA. Also, the resistance R1 is connected to a negative input terminal of the operating amplifier OP1, and the capacitor C is connected to a positive input terminal of the operating amplifier OP1. The grounded variable resistance VR is connected to the middle point of the connection between the operating amplifier OP1 and the capacitor C. An output terminal of the operating amplifier OP1 is connected via a resistance R2 to the middle point of the connection between the resistance R1 and the operating amplifier OP1.

Figure 15A:
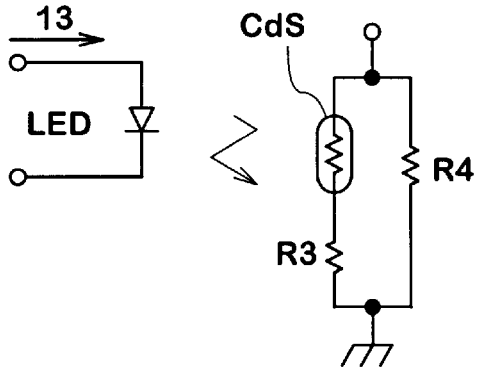
FIG. 15A is a circuit diagram illustrating an example of a variable resistance of FIG. 14.
Figure 15B:
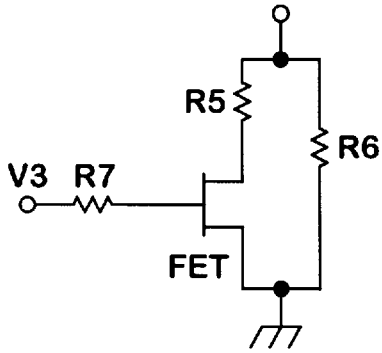
FIG. 15B is a circuit diagram illustrating another example of a variable resistance of FIG. 14.

Examples of the variable resistance VR are shown in FIGS. 15A and 15B. The variable resistance shown in FIG. 15A includes: a light emitting diode (LED) whose strength of light varies depending on control current applied thereto; a CdS whose conductivity varies depending on the received strength of light; resistance R3 connected to the CdS in series; and resistance R4 connected to the CdS and the resistance R3 in parallel. The variable resistance shown in FIG. 15B includes: resistance R5; a field effect transistor (FET) wherein one of a drain and a source is connected to the resistance RS and the other is grounded; resistance R6 connected to the resistance RS and the FET in parallel; resistance R7 connected to a gate of the FET. Control voltage V3 is applied to the gate of the FET via the resistance R7. When the resistance R1 and R2 having the same resistance value are used, and when $C_1$ is used for the capacitance of the capacitor and $VR_1$ is used for the resistance value of the variable resistance, a transfer function H of the all pass filters APF1 and APF2 is represented by the following equation:

$$H=(s-\omega_0)/(s+\omega_0)$$

wherein $\omega_0=1/(C_1 \cdot VR_1)$.

Figure 16:
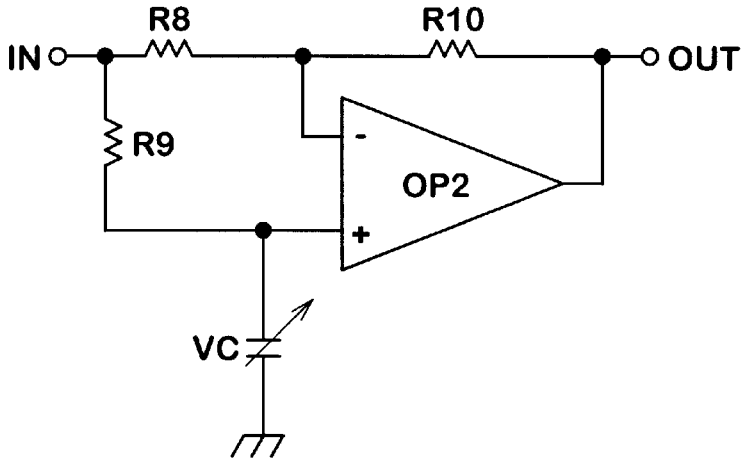
FIG. 16 is a circuit diagram illustrating another example of an APF of FIG. 11.

Alternatively, as shown in FIG. 16, the all pass filter includes: resistance R8, R9 and R1O; a variable capacitor VC; an operating amplifier OP2. The voltage control amplifier VCA is connected to a negative input terminal of the operating amplifier OP2 via the resistance RS and is connected to a positive input terminal of the operating amplifier OP2 via the resistance R9. The grounded variable capacitor VC is connected to the middle point of the connection between the operating amplifier OP2 and the resistance R9. An output terminal of the operating amplifier OP2 is connected via a resistance R10 to the middle point of the connection between the resistance RS and the operating amplifier OP2.

Figure 17:
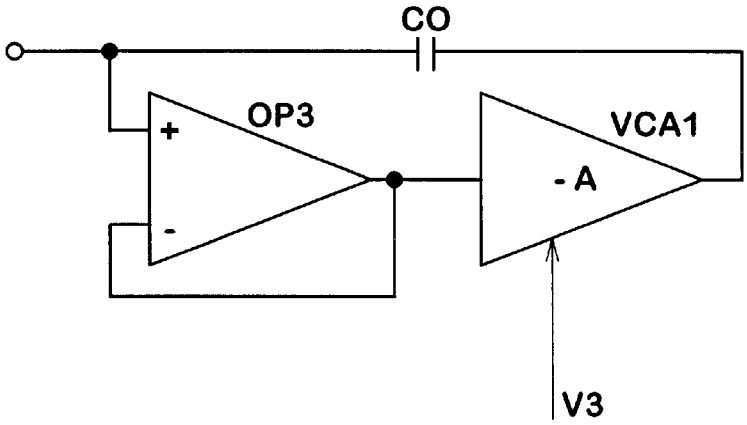
FIG. 17 is a circuit diagram illustrating an example of a variable capacitor of FIG. 16.

An example of the variable capacitor VC is shown in FIG. 17. The variable capacitor shown in FIG. 17 includes an operating amplifier OP3, a voltage control amplifier VCA1, and a capacitor CO. The middle point of the connection between the resistance R9 and the operating amplifier OP2 is connected to a positive input terminal of the operating amplifier OP3 and the capacitor CO. An output terminal of the operating amplifier OP3 is connected to a negative input terminal thereof and an input terminal of the voltage control amplifier VCA1. An output terminal of the voltage control amplifier VCA1 is connected to the capacitor CO. An amplification −A of the voltage control amplifier VCA1 is controlled by the control voltage V3 applied thereto. When $CO_1$ is used for a capacitance of the capacitor C, a capacitance $VC_1$ of the variable capacitor VC is represented by the following equation:

$$VC_1=(1+A)CO_1$$

Furthermore, when the resistance R8 and R10 having the same resistance value are used, and when $R9_1$ is used for the resistance value of the resistance R9, a transfer function H of the all pass filters APF1 and APF2 is represented by the following equation:

$$H=-(s=\omega_0)/(s+\omega_0)$$

wherein $\omega_0=1/(VC_1\cdot R9_1)$.

Although the all pass filter having the first order is exemplified in FIGS. 14 and 16, an all pass filter having any suitable order may be employed. An all pass filter having higher order may include all pass filters having the first order connected in cascade.

A first and a second power amplifier AMP1 and AMP2 are connected to the first and the second all pass filters APF1 and APF2, respectively. The power amplifiers AMP1 and AMP2 amplify the branched signals S3 and S4 and supply the amplified signals to the left and the right speakers SPL and SPR.

According to the above-mentioned examples, the audio signal S1 produced from the voltage control oscillator VCO is amplified by the voltage control amplifier VCA to produce the amplified and branched signals S2. The amplified and branched signals S2 are supplied to the first and the second all pass filter APF3 and APF2, respectively, so as to produce the phase-controlled and branched signals S3 and S4. The phase-controlled and branched signals S3 and S4 are amplified by the first and the second power amplifiers AMP1 and AMP2 and supplied to the left and the right speakers SPL and SPR. The speakers SPL and SPR output a sound wave so as to form sound image.

Next, the case of making a listener to feel that sound image is moving from rearward of the middle between the left and the right speakers SPL and SPR to rearward of the listener, will be described. This technique includes performing a signal control for prescribed period of time in two steps. The details are as follows.

Figure 18:
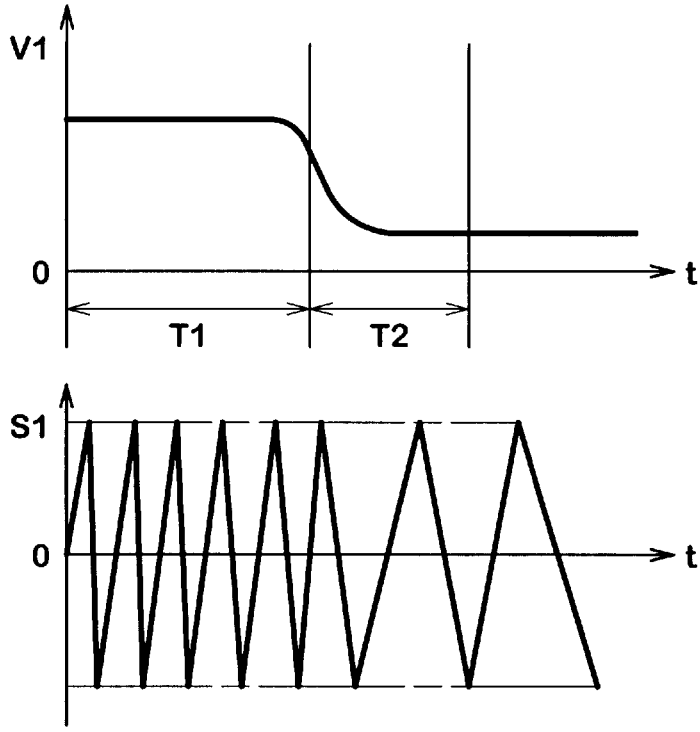
FIG. 18 is a graph illustrating a relationship between voltage V1 applied to VCO and a frequency of an audio signal S1, both of which are shown in FIG. 11.

In the first step, the signal control is performed for a first period of time T1 (usually, T1 is in the range of approximately 0.5 to several seconds). T1 is appropriately set in consideration of a sound image movement speed and the like. As shown in FIG. 18, the signal control in the first step includes keeping substantially constant the control voltage V1 applied to the voltage control oscillator VCO, so as to keep substantially constant a frequency of the output audio signal S1.

Figure 19:
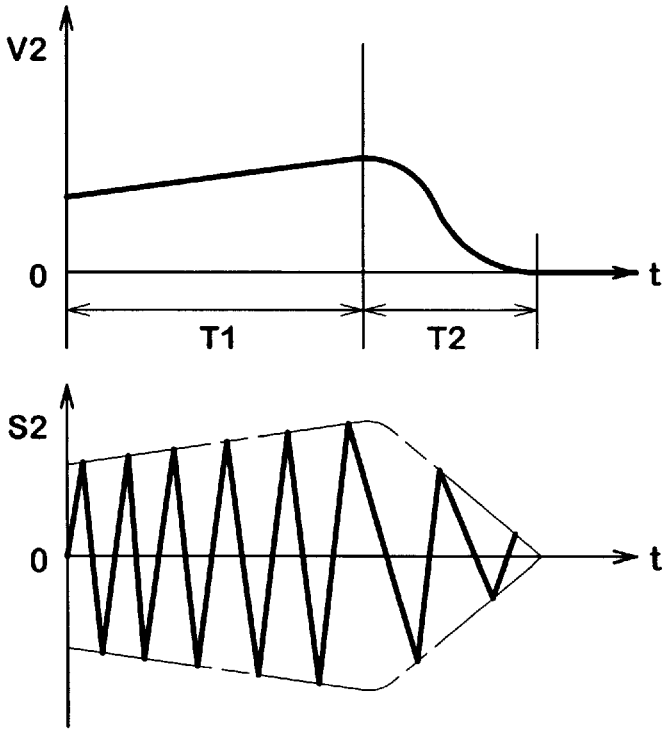
FIG. 19 is a graph illustrating a relationship between voltage V2 applied to VCA and a frequency of a branched signal S2, both of which are shown in FIG. 11.

Furthermore, as shown in FIG. 19, the signal control includes gradually increasing the control voltage V2 applied to the voltage control amplifier VCA, so as to gradually increase an amplitude of the branched signals S2 to be output. As a result, sound pressure level of the listener with respect to the reproduced sound of the speakers SPL and SPR would be gradually increased.

Figure 20:
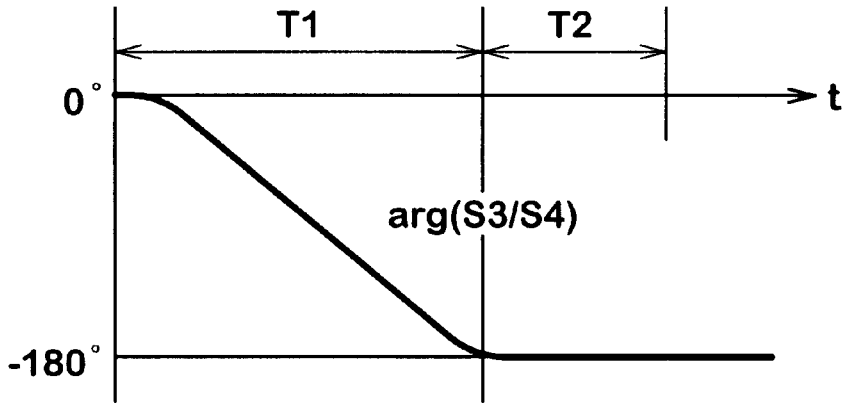
FIG. 20 is a graph illustrating a phase difference between branched signals S3 and S4 shown in FIG. 11.

In addition, by controlling the turnover frequency of the first and the second all pass filters APF1 and APF2, the phase difference $\phi$ between the branched signals S3 and S4 (i.e., a declination arg(S3/S4)) would be gradually varied from about 0 degree to about −180 degrees, as shown in FIG. 20.

According to the above-mentioned signal control in the first step, sound pressure level of the listener with respect to the reproduced sound of the speakers SPL and SPR is gradually increased. Furthermore, the phase difference is gradually varied from about 0 degree to about −180 degrees. As a result, it is possible to make a listener to clearly feel that sound image is moving from rearward of the middle between the left and the right speakers SPL and SPR to the vicinity of the back of the listener's head.

After the above-mentioned period of time T1, the below-indicated control procedure is carried out for a prescribed period of time T2 (usually, T2 is in the range of about 0.1 to about 2 seconds). T2 is appropriately set in consideration of a sound image movement speed and the like. As shown in FIG. 19, the signal control in the second step includes decreasing the control voltage V1 applied to the voltage control oscillator VCO. As a result, as shown in FIG. 19, a frequency of the output audio signal S1 is shifted to low frequency side, so as to provide the Doppler effect. The shift of the frequency may be performed gradually or at once.

Furthermore, as shown in FIG. 19, the signal control in the second step includes drastically decreasing the control voltage V2 applied to the voltage control amplifier VCA to substantially zero, so as to drastically decrease an amplitude of the branched signals to be output to substantially zero. As a result, sound pressure level of the listener with respect to the reproduced sound of the speakers SPL and SPR would be drastically decreased to substantially zero.

In addition, by keeping substantially constant the turnover frequency of the first and the second all pass filters APF1 and APF2, the phase difference $\phi$ between the branched signals S3 and S4 (i.e., a declination arg(S3/S4)) would be kept at approximately −180 degrees. As a result, the phase difference between the reproduced sound of the left and the right speakers would be kept at approximately −180 degrees, as shown in FIG. 20.

According to the above-mentioned signal control in the second step, a frequency of the reproduced sound from the speakers SPL and SPR is shifted to low frequency side to provide the Doppler effect. Furthermore, sound pressure level of the listener is drastically decreased to substantially zero. As a result, it is possible to make a listener to clearly feel that sound image is moving from the vicinity of the back of the listener's head to further rearward of the listener.

As described above, the signal control realizes the Doppler effect due to the shift of the frequency component, the feeling of a sound image movement due to the variation of sound pressure level, and the feeling of a sound image movement due to the phase difference. The above-mentioned combination makes a listener to clearly feel that sound image is moving from rearward of the middle between the left and the right speakers SPL and SPR to rearward of the listener.

Next, the case of making a listener to feel that sound image is moving from rearward of the listener to rearward of the middle between the left and the right speakers SPL and SPR, will be described. This technique also includes performing a signal control for prescribed period of time in two steps. The details are as follows.

Figure 21:
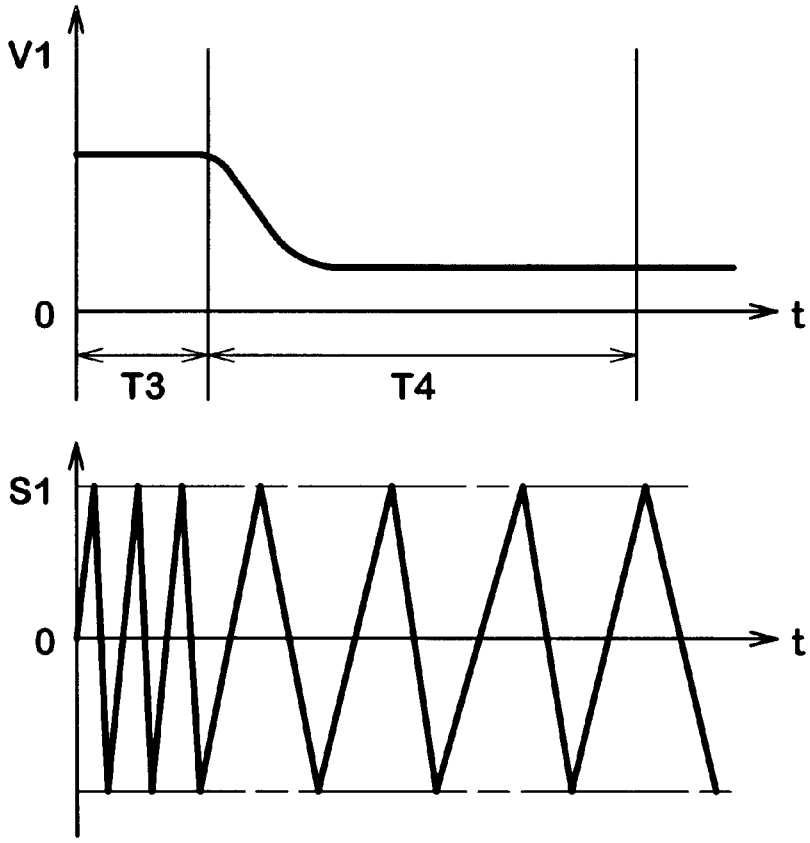
FIG. 21 is a graph illustrating a relationship between voltage V1 applied to VCO and a frequency of an audio signal S1, both of which are shown in FIG. 11.

In the first step, the signal control is performed for a first period of time T3 (usually, T3 is in the range of approximately 0.1 to 0.5 seconds). T3 is appropriately set in consideration of a sound image movement speed and the like. As shown in FIG. 21, the signal control in the first step includes keeping substantially constant the control voltage V1 applied to the voltage control oscillator VCO, so as to keep substantially constant a frequency of the output audio signal S1.

Figure 22:
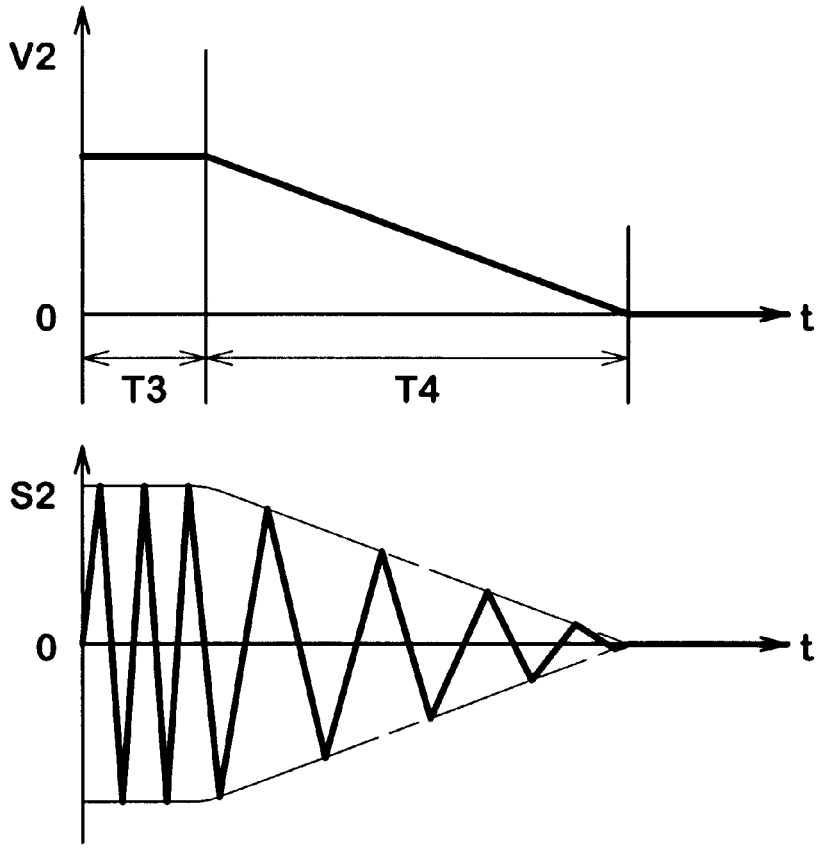
FIG. 22 is a graph illustrating a relationship between voltage V2 applied to VCA and a frequency of a branched signal S2, both of which are shown in FIG. 11.

Furthermore, as shown in FIG. 22, the signal control includes keeping substantially constant the control voltage V2 applied to the voltage control amplifier VCA, so as to keep substantially constant an amplitude of the branched signals S2 to be output. As a result, sound pressure level of the listener with respect to the reproduced sound of the speakers SPL and SPR would be kept substantially constant.

Figure 23:
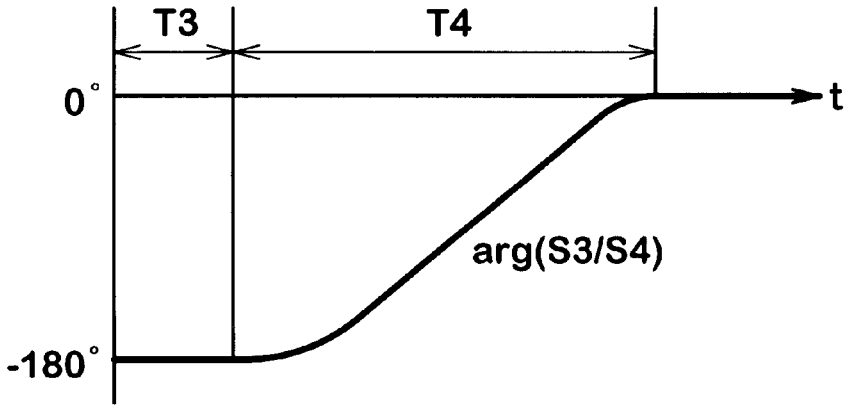
FIG. 23 is a graph illustrating a phase difference between branched signals S3 and S4 shown in FIG. 11.

In addition, by controlling the turnover frequency of the first and the second all pass filters APF1 and APF2, the phase difference $\phi$ between the branched signals S3 and S4 (i.e., a declination arg(S3/S4)) would be kept at approximately −180 degrees, as shown in FIG. 23. As a result, the phase difference between the reproduced sound of the left and the right speakers SPL and SPR would be kept at approximately −180 degrees, so as to localize sound image in the vicinity of the back of the listener's head or rearwards thereto.

After the above-mentioned period of time T3, the below-indicated control procedure is carried out for a prescribed period of time T4 (usually, T4 is in the range of about 0.5 to several seconds). T4 is appropriately set in consideration of a sound image movement speed and the like. As shown in FIG. 21, the signal control in the second step includes decreasing the control voltage V1 applied to the voltage control oscillator VCO. As a result, since a frequency of the output audio signal S1 is shifted to low frequency side, a frequency of the reproduced sound from the left and the right speakers SPL and SPR is shifted to low frequency side so as to provide the Doppler effect.

Furthermore, as shown in FIG. 22, the signal control in the second step includes gradually decreasing the control voltage V2 applied to the voltage control amplifier VCA to substantially zero, so as to drastically decrease an amplitude of the branched signals S2 to be output to substantially zero. As a result, sound pressure level of the listener with respect to the reproduced sound would be gradually decreased to substantially zero.

In addition, by controlling the turnover frequency of the first and the second all pass filters APF1 and APF2, the phase difference $\phi$ between the branched signals S3 and S4 (i.e., a declination arg(S3/S4)) would be gradually decreased to substantially zero. As a result, the phase difference between the reproduced sound of the left and the right speakers SPL and SPR would be gradually decreased to substantially zero, as shown in FIG. 23.

According to the above-mentioned signal control in the second step, a frequency of the reproduced sound from the speakers SPL and SPR is shifted to low frequency side to provide the Doppler effect. Furthermore, the phase difference of the reproduced sound is gradually decreased to substantially zero. As a result, it is possible to make a listener to clearly feel that sound image is moving from the vicinity of the back of the listener's head or rearwards thereto to rearward of the middle between the left and the right speakers SPL and SPR.

As described above, the signal control realizes the Doppler effect due to the shift of the frequency component, the feeling of a sound image movement due to the variation of sound pressure level, and the feeling of a sound image movement due to the phase difference. The above-mentioned combination makes a listener to clearly feel that sound image is moving from the vicinity of the back of the listener's head or rearwards thereto to rearward of the middle between the left and the right speakers SPL and SPR.

According to this embodiment, it is possible to make a listener to clearly feel that sound image is moving forward and backward. For example, when the present invention is applied to an amusement equipment, the feeling would be emphasized in combination with a mental process. More specifically, when the present invention is applied to a so-called arcade game (e.g., a shooting game, a driving game) or a video game, a game player can be provided with a realistic feeling by combining a picture and a sound image movement. Especially, when the present invention is applied to sound of explosion in a shooting game, reality of the game would be drastically improved.

Embodiment 3

Figure 24:
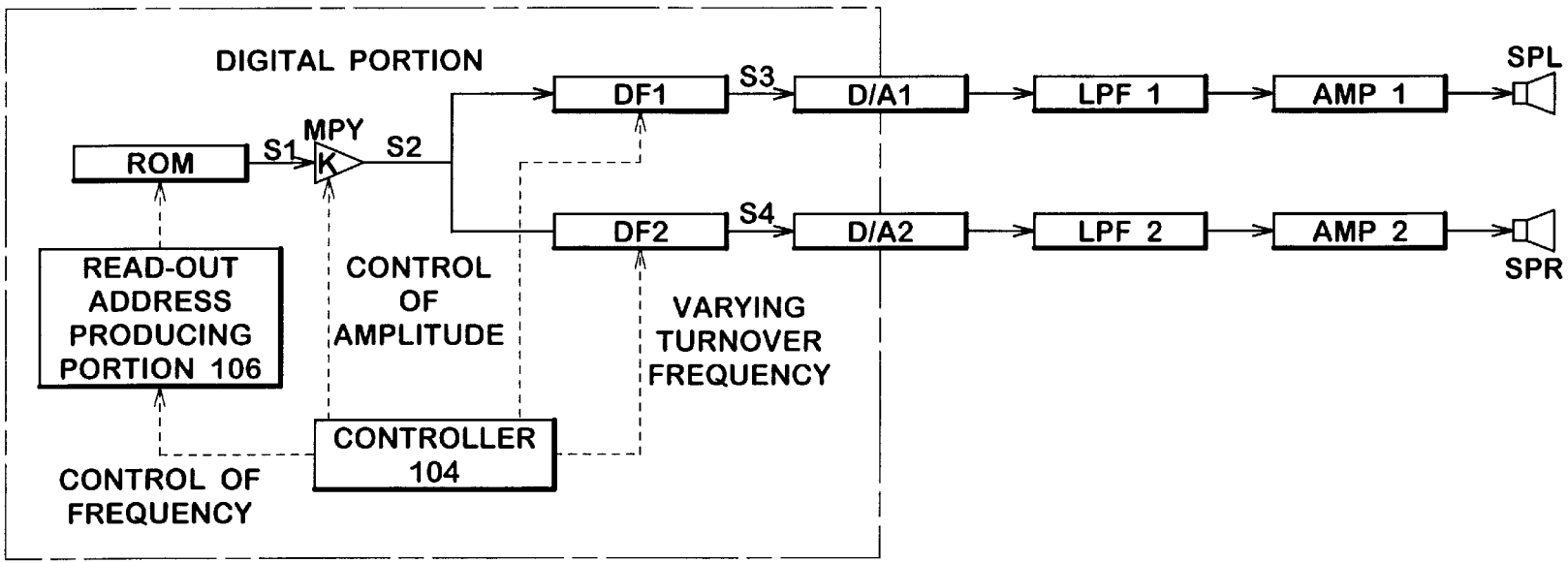
FIG. 24 is a block diagram illustrating still another embodiment of an apparatus for localizing sound image according to the present invention.
Figure 25:
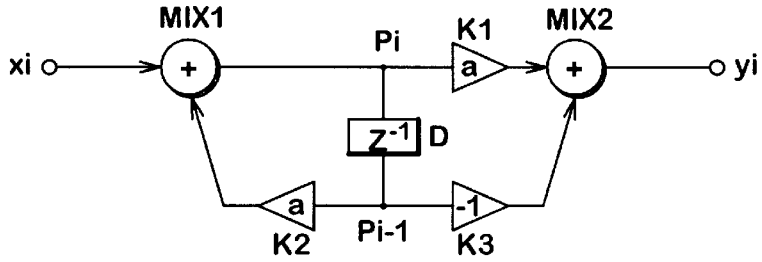
FIG. 25 is a block diagram illustrating signal flow of digital APF of FIG. 24.
Figure 26:
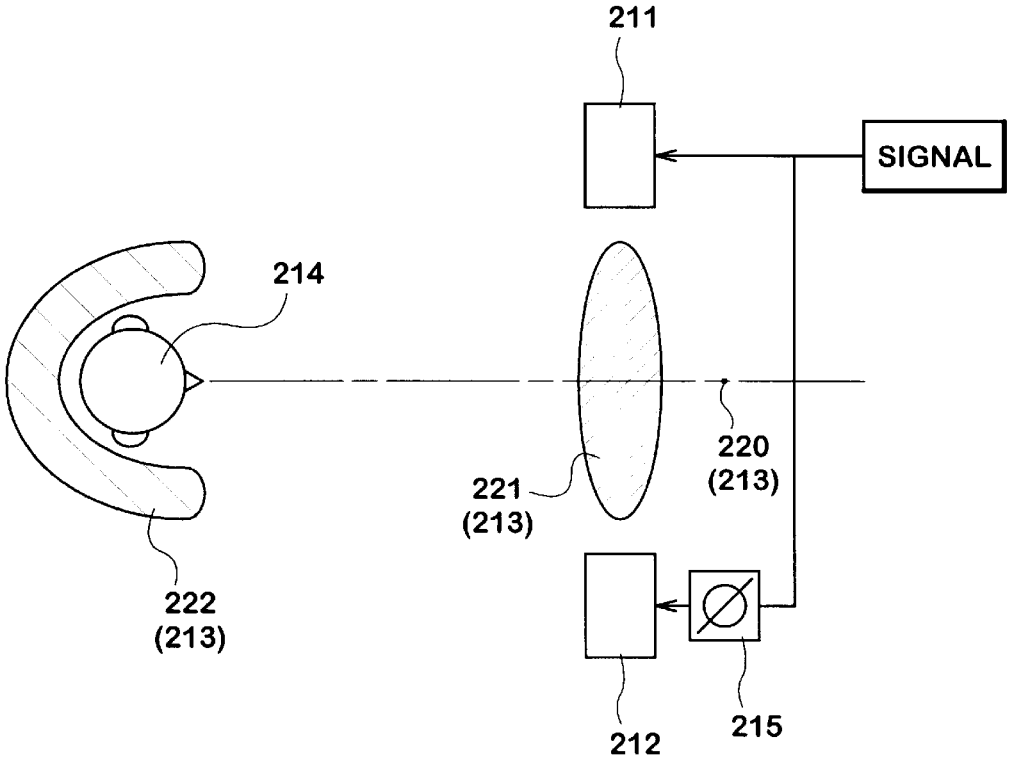
FIG.26 PRIOR ART
FIG. 26 is a schematic diagram illustrating conventional method for localizing sound image.

Referring to FIGS. 24 and 25, still another embodiment according to the present invention will be described. This embodiment relates to a digital type sound image localization apparatus.

FIG. 24 is a block diagram illustrating an apparatus according to this embodiment. In FIG. 24, the portion enclosed with a chain line shows a "digital" portion. In this embodiment, read-only memory (ROM) is used as an audio signal source and a read-out address producing portion 106 is used as a shifting means.

For example, an audio data (an audio signal data) including one or more period of sound effect is sequentially stored from the address $00 to the address $FF in the memory.

The audio data is read-out so as to produce an audio signal S1. Furthermore, a frequency component of the audio signal S1 is appropriately shifted by controlling a read-out speed.

The read-out address producing portion 106 produces a 16-bit address which reads the audio data from the memory. For example, ADDR=$0000 is used for an initial data and a calculation ADDR=ADDR+dADD is performed with respect to every read-out crock signal. In the calculation, a carry of the most significant is ignored and the audio data is read from the memory with the higher-order 8-bit being a read-out address. If dADD=$100, since the audio data is read-out at the same speed as that when the data is stored, a frequency component of the audio signal S1 is not shifted. If dADD≧$101, since the audio data is read-out at a higher speed than that when the data is stored, a frequency component of the audio signal S1 is shifted to high frequency side. Furthermore, if dADD≦$OFF, since the audio data is read-out at a lower speed than that when the data is stored, a frequency component of the audio signal S1 is shifted to low frequency side. Accordingly, by controlling the dADD value with the controller 104, it is possible to shift a frequency component of the audio signal S1.

A coefficient multiplying means MPY is used as an amplitude control means. The amplitude of the audio signal S1 is varied by multiplying the audio signal S1 by a coefficient k which is controlled by the controller 104, so as to produce the branched signals S2.

A first and a second IIR type digital all pass filters DF1 and DF2 are used as a phase difference control means. An example of the filters DF1 and DF2 is as shown in FIG. 25. An input signal $x_i$ is processed with an adding means MIX1 to produce a signal $P_i$. The signal $P_i$ is multiplied by a filtering coefficient a with a coefficient multiplying means K1 and supplied to a second adding means MIX2. Also, the signal $P_i$ is delayed as much as a unit sampling cycle (a sampling interval) with a delaying circuit D so as to produce a signal $P_{i-1}$. The signal $P_{i-1}$ is multiplied by a filtering coefficient a with a coefficient multiplying means K2 and added to the signal $P_1$ with the adding means MIX1. The signal $P_{i-1}$ is also multiplied by −1 with a coefficient multiplying means K3 and input to the second adding means MIX2. As a result, an output signal $y_i$ is produced. The filtering coefficient a is in the range of $-1 \leqq a < 1$. The upper limit of the filtering coefficient a contributes to control a turnover frequency of the digital all pass filters DF1 and DF2. A transfer function H(z) is represented by the following equations:

$$\begin{aligned} H(z) &= Y(z)/X(z) \\ &= a[z-(1/a)]/(z-a) \\ &= (a-z^{-1})/(1-az^{-1}) \end{aligned}$$

Although the all pass filter having the first order is exemplified in FIG. 25, an all pass filter having any suitable order may be employed. An all pass filter having higher order may include all pass filters having the first order connected in cascade.

The first all pass filter DF1 is connected to the first power amplifier AMP1 via a first digital/analog converter DA1 and the first low pass filter LPF1. Also, the second all pass filter DF2 is connected to the second power amplifier AMP2 via a second digital/analog converter DA2 and the second low pass filter LPF2.

A digital signal processor (DSP) may also be used in place of the memory, the read-out address producing portion 106, the coefficient multiplying means MPY, the digital all pass filters DF1 and DF2, and the controller 104.

Although the branched signals output from the voltage control amplifier has been described, the branched signal may be output from any of the shifting means, the phase difference, the voltage control oscillator and the all pass filter.

As described above, the present invention makes a listener to clearly feel that sound image is moving forward and backward with respect to the listener by the combination of the Doppler effect due to the shift of the frequency component, the feeling of a sound image movement due to the variation of sound pressure level, and the feeling of a sound image movement due to the phase difference.

The present invention is preferably applicable to, for example, a home audio/visual (A/V) system, a surround audio reproduction apparatus, and sound effect reproduction in an amusement equipment.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for localizing sound image, comprising the steps of:

providing a left speaker and a right speaker in front of a listener;

subjecting an audio signal to a sound image localization treatment, so as to produce a processed signal; and supplying the processed signal to the left and the right speakers, so as to localize sound image at a predetermined position wherein the method comprises:

producing a first processed signal which localizes sound image at a first localization position and a second processed signal which localizes sound image at a second localization position;

multiplying one of the first and the second processed signals by a coefficient k which varies in the range of 0 to 1 at random;

multiplying the other signal by a coefficient 1−k; and adding the processed signal multiplied by the coefficient k and the processed signal multiplied by the coefficient 1−k;

wherein, when the predetermined position is located away at an angle θ in a circumferential direction from the front of the listener, the first localization position is in the vicinity of the predetermined position and located away at an angle $\theta_1$ in said circumferential direction from the front of the listener wherein $\theta_1<\theta$, and the second localization position is in the vicinity of the predetermined position and located away at an angle $\theta_2$ in said circumferential direction from the front of the listener wherein $\theta_2>\theta$.

2. A method according to claim 1, wherein a spectrum of the coefficient k has 1/f characteristics.

3. A method according to claim 1, wherein a production of the coefficient k includes outputting a random signal having rectangular pulse shape, height of 1, and random pulse width and pitch, and integrating the random signal in an integration circuit.

4. A method according to claim 1, wherein a production of the coefficient k includes squaring the audio signal by a squaring circuit, and processing the squared signal through a low pass filter.

5. A method according to claim 4, wherein the audio signal is a 2-channel stereophonic signal, and a signal for producing the coefficient is selected from a signal of one of the channels, an added signal of the both channel, or a differential signal of the both channel.

6. An apparatus for localizing sound image, comprising:

a left and a right speakers to be provided in front of a listener;

a means for subjecting an audio signal to a sound image localization treatment so as to produce a processed signal; and a means for supplying the processed signal to the left and the right speakers so as to localize sound image at a predetermined position wherein the apparatus comprises:

a means for producing a first processed signal which localizes sound image at a first localization position;

a means for producing a second processed signal which localizes sound image at a second localization position;

a means for producing a coefficient k which varies in the range of 0 to 1 at random;

a means for multiplying one of the first and the second processed signals by the coefficient k;

a means for multiplying the other signal by a coefficient 1−k; and a means for adding the processed signal multiplied by the coefficient k and the processed signal multiplied by the coefficient 1−k and supplying the added signal to the left and the right speakers;

wherein, when the predetermined position is located away at an angle θ in a circumferential direction from the front of the listener, the first localization position is in the vicinity of the predetermined position and located away at an angle $\theta_1$ in said circumferential direction from the front of the listener wherein $\theta_1<\theta$, and the second localization position is in the vicinity of the predetermined position and located away at an angle of $\theta_2$ in said circumferential direction from the front of the listener wherein $\theta_2>\theta$.

* * * * *